United States Patent [19]

Maloof

[11] 4,018,501

[45] Apr. 19, 1977

[54] MULTIPLE TERMINAL CONNECTOR PLUG

[75] Inventor: Robert Edward Maloof, East Greenwich, R.I.

[73] Assignee: Victor Electric Wire & Cable Corporation, West Warwick, R.I.

[22] Filed: Aug. 4, 1975

[21] Appl. No.: 601,711

[52] U.S. Cl. ..... 339/183

[51] Int. Cl.[2] ..... H01R 17/18

[58] Field of Search ..... 339/183, 102 R, 218 R, 339/218 M

[56] References Cited

UNITED STATES PATENTS

| | | | |
|---|---|---|---|
| 1,161,194 | 11/1915 | Cook | 339/183 |
| 1,837,754 | 12/1931 | Calmus et al. | 339/183 |
| 2,857,580 | 10/1958 | Raetsch | 339/183 |
| 2,857,581 | 10/1958 | Henning | 339/183 |
| 2,878,459 | 3/1959 | Barker | 339/183 |

*Primary Examiner*—Roy Lake
*Assistant Examiner*—Neil Abrams
*Attorney, Agent, or Firm*—Salter & Michaelson

[57] ABSTRACT

A multiple terminal connector plug having an outer head pin that defines a first terminal electrically insulated from spaced tubular terminals, the diameters of which correspond generally to that of the head pin, the tubular terminals being secured in electrically insulated spaced relation by a molded plastic material that is applied in a preliminary step, the entire construction including the interconnection of the terminals to conducting wires being fixed in position by a molded body that provides for manipulation and use of the plug and that further encapsulates the connection of the conductor wires to the tubular terminals.

1 Claim, 7 Drawing Figures

MULTIPLE TERMINAL CONNECTOR PLUG

BACKGROUND OF THE INVENTION

The present invention relates to a multiple terminal male connector plug and has particular application as a jack for use in calculators and similar solid state equipment and other electrical equipment such as hi-fi, data processing and similar kinds of devices.

In some electrical equipment that incorporate jacks therein for interconnecting or plugging in an auxiliary piece of equipment to a cabinet or the like, it is sometimes useful to provide a multiple terminal jack that can accommodate the special needs of the equipment in which it is used. Although multi-terminal male connector plugs have been known heretofore, the required complicated and specially machined parts therein necessarily increased the cost of the unit and also necessitated special assembly procedures that further required either special skills of the worker or additional equipment for the assembly method. Male connector plugs utilizing multiple terminals in these prior known devices were not always of quality production because of the number of parts required in the assembly thereof, and it was not uncommon in such devices to experience shorting and failures in the use thereof.

SUMMARY OF THE INVENTION

The present invention relates to a multiple terminal male connector plug that includes an outer head pin that defines a first terminal. A first conductor is joined to the head pin centrally thereof and extends rearwardly with respect thereto. An elongated sleeve is mounted around the head pin in coaxial relation and defines a second terminal, the sleeve being annularly spaced with respect to a portion of the head pin. A tubular member is located in surrounding coaxial relation with respect to the sleeve and defines a third terminal, other conductors being joined to the second and third terminals and defining separate circuits therewith. Premolded portions are applied between the sleeve and tubular member during the assembly procedure for insulating these parts and for holding them in proper oriented relation prior to the final assembly, a body being molded onto a portion of the tubular member and locating the terminals in the final fixed relation relative to each other. Portions of the head pin, sleeve and tubular member are exposed after the body is molded to define an elongated and continuous plug that is receivable in a complementary female socket.

Accordingly, it is an object of the present invention to provide a male connector plug that includes a plurality of terminals that are essentially formed of drawn metal materials and that are located in axially spaced, insulated relation for securement in the fixed position thereof by a molded body that defines a hand grip for manipulating the plug.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
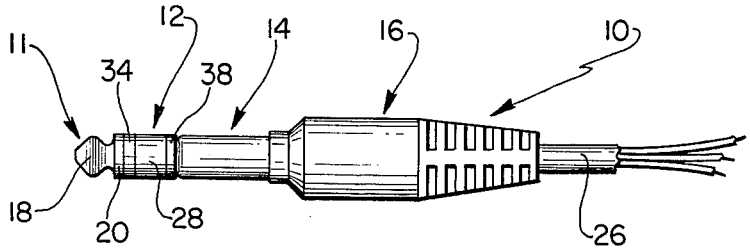
FIG. 1 is an elevational view of the multiple terminal male connector plug embodied in the present invention.

Referring now to the drawing, and particularly to FIG. 1, a multiple terminal connector plug as embodied in the present invention is illustrated and is generally indicated at 10. The connector plug 10 is of the type that is inserted into a complementary female socket and has application and use in hi-fi and stereo equipment, radio, data processing, communications and various other kinds of electronic devices that are equipped to receive a jack. The multiple connector plug of the present invention includes three separate terminals that define individual electrical circuits, and therefore has special application because of the multiple terminal feature. As illustrated, the connector plug 10 includes a head pin generally indicated at 11 that defines a first terminal, an intermediate sleeve generally indicated at 12 that defines a second terminal and a tubular member generally indicated at 14 that defines a third terminal. The head pin 11, sleeve 12 and tubular member 14 are constructed of metallic materials and arranged such that the annular working dimensions thereof are substantially the same and, therefore, define a continuous plug that is insertable into a complementary female socket. As will be further described, a molded plastic body generally indicated at 16 is formed around the rearmost ends of the sleeve 12 and tubular member 14 and, in addition to encapsulating the connections of conductor leads to the terminals, provides for easy handling and manipulation of the connector plug.

Figure 2:
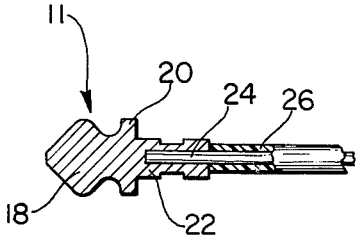
FIG. 2 is a sectional view showing a head pin to which a conductor is attached in the initial step of assemblying of the connector plug of the subject invention.
Figure 3:
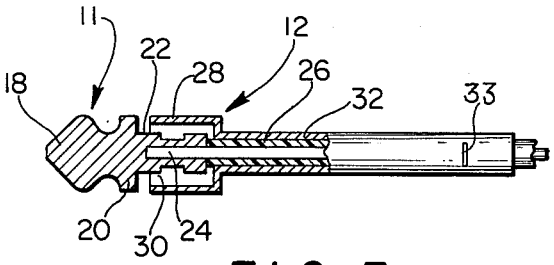
FIG. 3 is a sectional view showing the head pin and conductor as attached thereto being received within a drawn tubular sleeve that defines another terminal of the plug.
Figure 4:
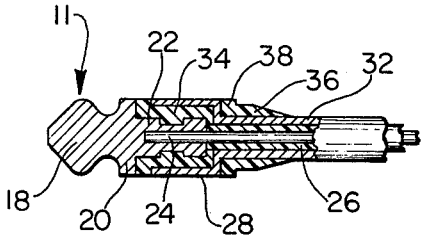
FIG. 4 is a sectional view similar to FIG. 3 illustrating preformed mold sections being inserted between the drawn tubular sleeve and the head pin and around an exterior portion of the sleeve.

One of the unique features of the invention is the manner in which the connector plug 10 is assembled. Referring now to FIGS. 2 through 7, the method of assembly of the terminals of the connector plug is illustrated and reference to the assembly of the plug will be made as the details of the terminals are described. As shown in FIG. 2, the head pin 10, which is formed of a metal conducting material, includes an outer portion that is defined by a tapered head 18 to which a flange 20 is joined. A rear portion 22 that is reduced with respect to the flange 20 and the head 18 extends rearwardly of the flange and is formed with a bore into which a conductor lead 24 is inserted. An insulation 26 covers the conductor lead 24 and abuts against the rearmost edge of the rear portion 22 of the head pin. With the conductor lead 24 inserted into the head pin 10, the sleeve 12 that defines the second terminal is next located in the position illustrated in FIG. 3. As shown, the sleeve 12 includes a forward enlarged portion 28 that is formed with an interior cavity 30 therein, the diameter of the enlarged portion 28 being substantially the same as that of the flange 20. A rearwardly extending tubular portion 32 is integrally joined to the forward portion 28 and has a bore of a diameter that accommodates the insulation 26 of the conductor lead 24 therein. The tubular portion 32 being crimped to the insulation 26 as indicated at 33 in FIG. 3. With the head pin 11 located in the position illustrated in FIG. 3 and with the reduced portion 22 of the head pin positioned in the cavity 30 of the sleeve 12, a premold material is introduced into the cavity as indicated at 34 to seal the rear portion 22 of the head pin 11 in the cavity 30, wherein the head pin 11 is insulated from the sleeve 12. The premold material 34 may be of any suitable plastic, such as polyurethane or the like, the material only being required to serve as an insulator between the head pin and sleeve while fixing the rear portion 22 of the head pin in the cavity 30. It is seen that the forwardmost end of the forward enlarged portion 28 of the sleeve 12 is insulated from the flange 20 by the premold material 34, the diameter of the premold material 34 in this area being substantially the same as the flange 20 and enlarged portion 28 and forming a continuous annular surface therewith. As further shown in FIG. 4, a premold material is inserted around the tubular portion 32 of the sleeve 12, as indicated at 36, to define an annular flange 38 that abuts against the rearmost end of the forward portion 28 of the sleeve 12. The remaining portion of the premold material 36 tapers downwardly toward the tubular portion 32 to enable the tubular member 14 to be inserted thereover, as to be described.

Figure 5:
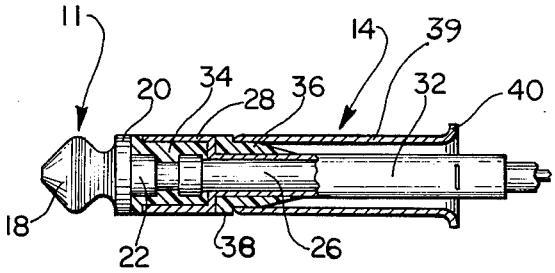
FIG. 5 is a sectional view with parts shown in elevation illustrating the mounting of a tubular portion on one of the premolded sections as located in surrounding relation with respect to the sleeve.
Figure 6:
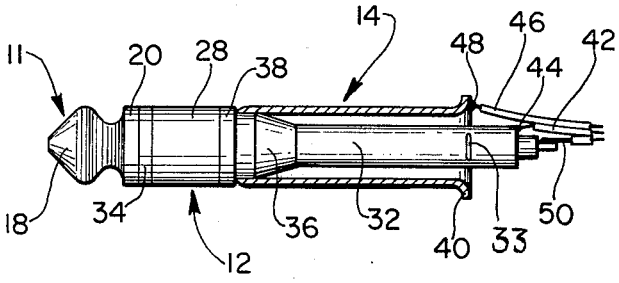
FIG. 6 is an elevational view of the connector after the attachment of conductor wires to the terminals, the tubular portion being illustrated in section.

Referring now to FIG. 5, the next step of the method of assembling the connector plug 10 is shown; and at this stage in the method of assembly, the tubular member 14 is illustrated after having been inserted in place in surrounding relation relative to the tubular portion 32 of the sleeve 12. The tubular member 14, which defines the third terminal, includes a body portion 39 and a rear flange 40 that is foreshortened with respect to the rearmost end of the tubular portion 32 of the sleeve 12. The forwardmost end of the body portion 39 of the tubular member 14 is received on a notch that is defined by the flange 38 of the premold material 36, the outer diameter of the body portion 39 thereby being substantially the same as that of the flange 38 of the premold material 36, the forward portion 28 of the sleeve 12, the flange 20 of the head pin 11, and the portion of the tapered head 18 that defines the largest diameter thereof.

Prior to sealing the tubular member 14 in place by the body 16, a first conductor wire 42 is secured to the rearmost end of the tubular portion 32 of the sleeve 12 at the solder connection 44; and, similarly, a second conductor wire 46 is secured to the flange 40 of the tubular member 14 at the solder connection 48. The conductor lead 24 of the head pin 11 is secured to a third conductor wire 50 that extends rearwardly therefrom, such connection also being joined by a suitable solder joint.

Figure 7:
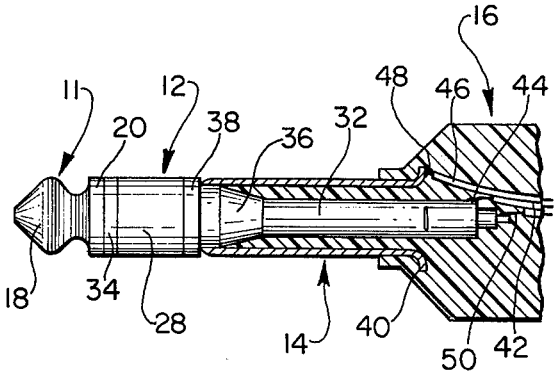
FIG. 7 is an elevational view with parts shown in section and illustrating a plastic body after the molding thereof onto the inner ends of the terminals of the connector plug.

With the tubular member 14 located in surrounding relation with respect to the tubular portion 32 of the sleeve 12 and after the securement of the conducting wires 42, 46 and 50 in place on their respective terminals, the body 16 is then molded in place on the rearmost ends of the tubular member 14 and sleeve 12. As illustrated in FIG. 7, during the molding of the body 16, the plastic material that defines the body 16 is allowed to flow interiorly of the tubular member 14 to secure the tubular member in position, the plastic material that defines the body 16 also providing an insulation between the tubular member 14 and the rearwardly extending tubular portion 32 of the sleeve 11. As further shown in FIG. 7, the connections of the conducting wires to the terminals are encapsulated within the body 16, the body 16 being molded of a shape and configuration that provides for easy handling and manipulation when the plug is to be inserted into a female socket. If required, the premold material 34 and 36 could be molded simultaneously with the body 16, it being understood that appropriate fixturing would properly locate the elements during the molding process.

In the assembled form of the connector plug 10, it is seen that the terminals 11, 12 and 14 define an elongated plug that is easily inserted into a complementary female socket, the head pin 11, sleeve 12 and tubular member 14 each forming a separate electrical circuit for contact with a corresponding terminal within the female socket. The head pin 11 is appropriately insulated from the sleeve 12 by the premold material 34, while the tubular member 14 is insulated from the sleeve 11 by the premold material 36 and the portion of the body 16 that has flowed interiorly of the tubular member 14 and around the tubular portion 32 of the sleeve 11.

It is also contemplated to form the body 16 with an angular or offset portion in which case the insulation 26 which houses the conductor wires would extend at right angles with respect to the axis of the sleeve 12 and tubular member 14.

It is further contemplated that the connector plug be utilized as a swivel connector and in this connection the tapered head 18 would be removed, the remaining flange 20 being receivable in a female socket. Additional spring contacts would then be provided for wipingly engaging the sleeve 12 and the body portion 39 of the tubular member 32.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claim.

What is claimed is:

1. A multiple terminal male connector plug, comprising an outer head pin that defines a first terminal, a first conductor lead joined to said head pin and extending rearwardly thereof, an elongated sleeve formed of a conductive material extending rearwardly of said head pin in coaxial relation and defining a second terminal, a tubular member formed of a conductive material located in surrounding coaxial relation with respect to said sleeve and defining a third terminal, and additional conductor leads joined to said second and third terminals and defining separate circuits therewith, and a body molded onto a portion of said tubular member and locating said terminals in fixed relation relative to each other, portions of the head pin, sleeve and tubular member being exposed to define a continuous plug for being received in a complementary female socket, said first conductor lead extending centrally of said sleeve and tubular member and being secured to said head pin to define an electrical circuit therewith, the other said additional conductor leads being secured to said sleeve and tubular portion at the rearmost ends thereof and being encapsulated in said molded body, thereby defining separate electrical circuits through said plug, said head pin including a forward contact portion that defines the forwardmost end of said plug and a reduced rear portion, said first conductor lead being joined to said reduced rear portion axially thereof, said sleeve including a forward portion that is spaced rearwardly of the forward contact portion of the head pin and being insulated therefrom and surrounding the reduced rear portion of said head pin and being insulated therefrom, a rearwardly extending portion of said sleeve being integrally joined to the forward portion thereof and enveloping an insulated section of said first conductor lead, an insulator separating the forward end of said tubular member from the forward portion of said sleeve, said molded body projecting between said tubular member and the rearwardly extending portion of said sleeve to provide an insulation therebetween, the forward portion of said sleeve having a cavity formed therein that receives the reduced rear portion of said head pin, said cavity including an annular shoulder spaced rearwardly of said rear portion of said head pin, a second insulator enveloping the reduced rear portion of said head pin in said cavity and extending outwardly of said cavity to space the forwardmost edge of the forward portion of said sleeve from said forward contact portion of said head pin.

* * * * *